US005865662A

United States Patent [19]

Dammann

[11] Patent Number: 5,865,662

[45] Date of Patent: Feb. 2, 1999

[54] WEIGHT-ADJUSTED UNDERWATER TOY

[76] Inventor: Erik Dammann, Loftuveien 48, N-1450 Nesoddtangen, Norway

[21] Appl. No.: 553,452

[22] PCT Filed: May 27, 1994

[86] PCT No.: PCT/NO94/00099

§ 371 Date: Jan. 22, 1996

§ 102(e) Date: Jan. 22, 1996

[87] PCT Pub. No.: WO94/27695

PCT Pub. Date: Dec. 8, 1994

[30] Foreign Application Priority Data

May 28, 1993 [NO] Norway ..... 931944

[51] Int. Cl.[6] ..... A63H 3/26

[52] U.S. Cl. ..... 446/153; 273/140

[58] Field of Search ..... 446/153; 273/140, 273/447, 448, 457

[56] References Cited

U.S. PATENT DOCUMENTS

| | | | |
|---|---|---|---|
| 483,772 | 10/1892 | Sloan | 273/140 X |
| 934,179 | 9/1909 | Jackson | 273/140 |
| 1,399,855 | 12/1921 | Fierlein . | |
| 1,471,885 | 10/1923 | Dessau . | |
| 1,580,227 | 4/1926 | Wilhelm . | |
| 2,408,141 | 9/1946 | Heil | 273/140 X |
| 2,557,789 | 6/1951 | Lamka | 273/140 X |
| 3,106,394 | 10/1963 | Gelbart | 273/140 X |

FOREIGN PATENT DOCUMENTS

| | | |
|---|---|---|
| 27 23 286 A1 | 12/1978 | Germany . |
| 1 337 034 | 11/1973 | United Kingdom . |
| 2 084 032 A | 4/1982 | United Kingdom . |

*Primary Examiner*—William H. Grieb

*Attorney, Agent, or Firm*—Panitch Schwarze Jacobs & Nadel, PC

[57] ABSTRACT

A weight-adjusted underwater toy is disclosed having a somewhat lower specific gravity than water, and having its center of gravity located below and somewhat behind the volumetric center of the toy. The toy has a streamlined shape, like a fish, a sea animal, a swimmer, or a submarine. The model will follow a long glide curve similar to an approximately upside down ballistic path when flung into the water, and will always rotate into a position with its back up and its abdomen down. When rising, the location of the center of gravity will provide an inclined forward/upward position for the model, and horizontal side wings (fins or other details) will prevent a purely vertical rising movement by providing a forwardly directed momentum during a buoyancy movement. The weight adjustment takes place either by forming the model from a material which is heavier than water and is divided in two parts along a horizontal center section with an excavation in the top part in front of the center of the section surface, in such a manner that when joining the parts together, a sealed air pocket is formed, or by forming the model from a material which is lighter than water and has a heavier weight imbedded below and somewhat behind its volumetric center.

9 Claims, 2 Drawing Sheets

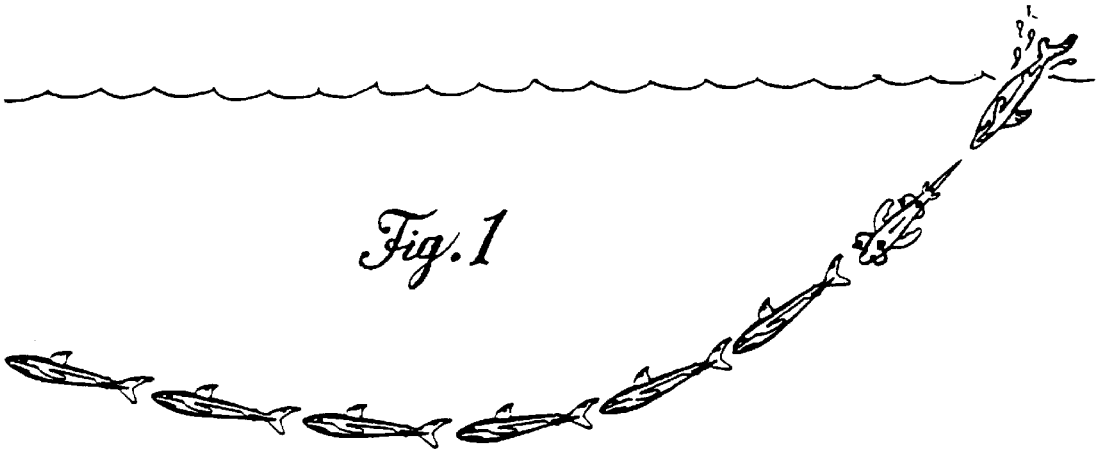
Fig. 1
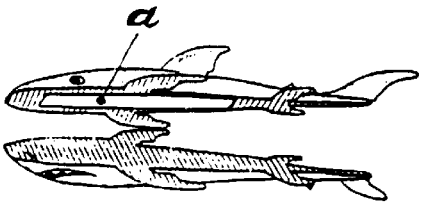
Fig. 2
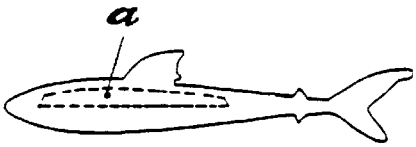
Fig. 3
Fig. 4
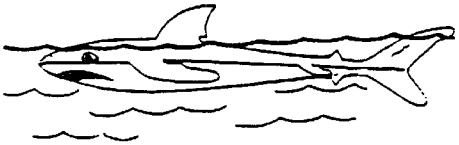

WEIGHT-ADJUSTED UNDERWATER TOY

BACKGROUND OF THE INVENTION

The invention relates to a toy with an elongate, streamlined shape, preferably fish or sea animal models for use in the sea, in a bathtub or in a swimming pool. The models are shaped and weight-adjusted with regard to providing a long glide curve underwater when flung down below the surface. The models are unmotorized and thus suitable for active play and for playing together. The center of gravity is in a low position, so that the models will find a correct swimming position in the water.

The ordinary unmotorized water toys in the form of models of fish and sea animals are unsuited to be flung and achieve a long movement path in water. Some of them will sink immediately. Others are light and not suited to do much more than floating on the surface.

There has also been manufactured weight-adjusted toy models of inter alia submarines with various devices, most often a motorized propulsion device, providing an automatic underwater movement for these toy models. Because the propulsion of the toy models is more or less independent of the active participation of the users, it will often turn out that these toys after some time will provide less motivation for active play.

GB 2,084,032 discloses an invention consisting of fish models in a transparent water container. The floating position of the models is determined by means of a weight in the abdomen and an air chamber thereabove. The specific weight is somewhat larger than water, however the models are prevented from sinking to the bottom by a magnet in the model abdomen, which is repelled by a magnet plate in the container bottom. The models are set in motion by a motor-operated pump which creates a changing water pressure inside the container.

The pressure variations create a movement in an elastic air chamber in the model body, which via a mechanical connection causes propulsive wagging of the model's tail. Because this invention presupposes a container with an attached pump, it cannot be used for free and active play outdoors.

GB 1,337,034 shows a toy shaped like a fish having elastic skin. A weight in the model abdomen provides a low center of gravity and a correct floating position. Propulsion is created by a motor inside the head of the fish model, which motor puts a built-in, wave-shaped rod into rotation around the axis of the wave-rod in the longitudinal direction of the model, in such a manner that it is rendered a "serpentine wriggling" movement.

U.S. Pat. No. 1,580,227 shows a previously known invention concerning creating attention for advertisement printed on models of fish, submarines or other objects which are submerged in a transparent container filled with a liquid. The specific weight of the models is adapted to keep them floating at a desired depth level in a given, clear liquid. A correct floating position is secured by means of a weight on the underside and an air compartment on the top to provide a low center of gravity for the model. Propulsion for the model can be provided by bringing an upward directed flow, possibly air bubbles, into the container from below. The vertically directed stream will engage inclined grooves or corrugations in the side surfaces of the model and thus cause a forwardly directed momentum. However, if used as a toy, this model will be unsuitable for active play in the sea, in a bathtub or in a swimming pool. The inclined grooves will, if the model is flung into the water, at first create a brief downward movement. If the toy exhibits buoyancy, the grooves will thereafter provide a momentum in the rearward direction.

U.S. Pat. No. 1,471,885 shows an unmotorized water toy where the main point is that models of e.g. fish or submarines are provided with a specific gravity similar to the specific gravity of water in order to stay afloat at a given depth. This can be achieved by manufacturing the model from a material which is lighter than water, however with a weight-adjusted heavier lower part, which will also ensure a correct floating position. An exact adaptation of the specific gravity of the model can also be made if the elastic skin of the model is filled with a material which will draw more or less water when squeezed together and thereafter released. From a stable depth level the model can possibly be rendered a rising movement by providing vertical water streams or air bubbles from below. However, when using this model, one will miss the possibility of user contribution to a natural, forward movement. Even though the model can be pushed somewhat in a forward direction, its shape and center of gravity are not adapted with consideration to a long glide curve in the water.

BRIEF SUMMARY OF THE INVENTION

The present invention relates to a weight-adjusted underwater toy having a somewhat lower specific gravity than water, and having its center of gravity located below and somewhat behind the volumetric center of the toy. The toy has a streamlined shape, like a fish, a sea animal, a swimmer, or a submarine. The model will follow a long glide curve similar to an approximately upside down ballistic path when flung into the water, and will always rotate into a position with its back up and its abdomen down. When rising, the location of the center of gravity will provide an inclined forward/upward position for the model, and horizontal side wings (fins or other details) will prevent a purely vertical rising movement by providing a forwardly directed momentum during a buoyancy movement. The weight adjustment takes place either by forming the model from a material which is heavier than water and is divided in two parts along a horizontal center section with an excavation in the top part in front of the center of the section surface, in such a manner that when joining the parts together, a sealed air pocket is formed, or by forming the model from a material which is lighter than water and has heavier weight imbedded below and somewhat behind its volumetric center.

BRIEF DESCRIPTION OF THE SEVERAL VIEWS OF THE DRAWINGS

FIG. 1 illustrates the long glide curve the model will follow when flung into the water, similar to an approximately upside down ballistic path.

FIG. 2 illustrates a preferred embodiment of the present invention in which the model is formed from a material which is heavier than water and is divided in two parts along a horizontal center section.

FIG. 3 illustrates the completed embodiment of FIG. 2.

FIG. 4 illustrates the model as it would float in the water at a standstill.

DETAILED DESCRIPTION OF THE INVENTION

Figure 5A:
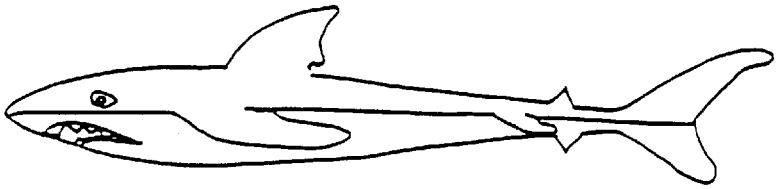
FIGS. 5*a*–5*f* illustrate various embodiments of the streamlined shape of the model, including a shark (FIG. 5*a*), a dolphin (FIG. 5*b*), a crocodile (FIG. 5*c*), a seal (FIG. 5*d*), a diver/swimmer (FIG. 5*e*), or a submarine (FIG. 5*f*).

Compared to the above mentioned, previously known toy and water models, the present invention will exhibit the following advantages: The models are independent of special water containers for their operation. The motion and the glide curve under water are influenced by the child itself, and they are independent of a motorized propulsion. The models have such shape and weight-adjustment that they—when flung with their nose first down into the water—will at first follow an elongate, curved glide line downward and forward. At the lowest point of the glide line the model shape, specific gravity and location of gravity center will cause forward motion to continue further with inclination forward/upward (FIG. 1). This is caused by a combination of the following features:

The specific gravity of the model is a little lower than the specific gravity of water (about 0,9 g/cm$^3$), so that the model will, even with a low start velocity, go far down and forward in the water, at the same time as it has the buoyancy to continue.

The center of gravity is located in a low position and somewhat to the rear of the volumetric center of the model. Hence the model will, even if flung with its back pointing downward, swiftly rotate to a correct swimming position, and when the propulsion energy from the throw has been spent, the model will, due to the gravity center location, turn its front slanted upward/forward.

In the rising movement the side fins placed along the longitudinal axis of the model, will counteract a vertical rising movement, since they provide a forward directed momentum to influence the buoyancy movement.

This particular combination of characteristics can be achieved in accordance with the invention in two ways, as shown in the drawing:

Either by manufacturing the model from a material which is heavier than water and which is cast in a top part and a lower part (FIG. 2), where there is an excavation in the section surface of the top part (a) somewhat in front of the volumetric center of the joined model (section, FIG. 3), in such a manner that the center of gravity is located low and behind the center, and the total specific gravity is lower than the specific gravity of water, or by using a material which is lighter than water, with an imbedded, heavier weight located behind and below the volumetric center of the model.

When at a standstill the model will be floating low in the water, with its front somewhat higher up than the rear end (FIG. 4).

Figure 5B:
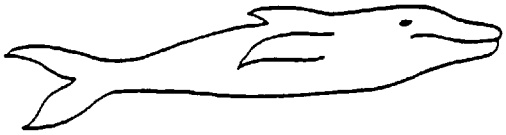
Figure 5C:
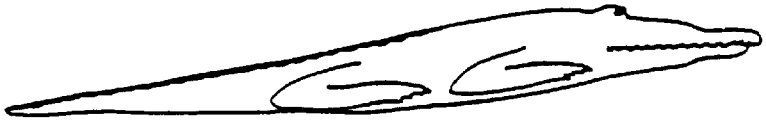
Figure 5D:
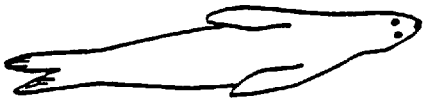
Figure 5E:
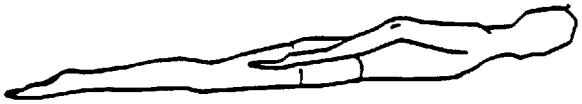
Figure 5F:
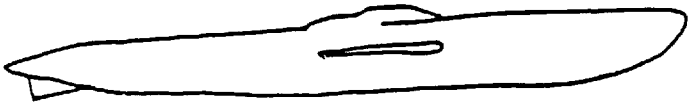

The shape of the model is elongate and with a streamlined shape to provide low resistance during a glide in the water, e.g. a shape like a shark (FIG. 5*a*), a dolphin (FIG. 5*b*), a crocodile (FIG. 5*c*), a seal (FIG. 5*d*), a diver/swimmer (FIG. 5*e*) or a submarine (FIG. 5*f*) and with side fins or other details like flippers, feet, hand palms, along the side surfaces of the model.

It is claimed:

1. A weight-adjusted underwater toy comprising an elongate body having a well defined forward-rearward sense and a top-bottom sense and being adapted to provide a flight or glide movement in water when flung or thrown into the water, or when released from a submerged state, said body having a lower specific gravity than water, so that buoyancy will always occur in water; and wherein the elongated body has its center of gravity located in a fixed position below and behind its volumetric center;

said body has a streamlined shape with a well defined forward movement direction shaped extremities; and said body is formed from a material having a higher density than water, and has at least one sealed air pocket whereby the specific gravity of the body together with the air pocket is less than that of water.

2. Underwater toy in accordance with claim 1, wherein said body is joined together from two parts (2), divided along a horizontal center plane when said body lies in a normal position, where the top part has an excavation in and above said center plane and somewhat in front of the volumetric center (2*a*) of the complete, joined body, to provide said air pocket (3) when the joining together has been established.

3. Underwater toy in accordance with claim 2, wherein said body is equipped with substantially horizontal wing members located along the sides of said body and having the form of fins, flippers, paws, hand palms or foils, placed along the side surfaces of said body to strengthen forward motion during a buoyancy movement (5).

4. Underwater toy in accordance with claim 1, wherein said body is equipped with substantially horizontal wing members located along the sides of said body and having the form of fins, flippers, paws, hand palms or foils, placed along the side surfaces of said body to strengthen forward motion during a buoyancy movement (5).

5. A weight-adjusted underwater toy comprising an elongate body having a well defined forward-rearward sense and a top-bottom sense and being adapted to provide a flight or glide movement in water when flung or thrown into the water, or when released from a submerged state, said body having a lower specific gravity than water, so that buoyancy will always occur in water, wherein the elongated body has its center of gravity located in a fixed position below and behind its volumetric center, said body has a streamlined shape with well defined forward movement direction shaped extremities, and wherein the body is shaped substantially from a material having a lower density than water, and has an imbedded weight member with a substantially higher density than water.

6. Underwater toy in accordance with claim 5, wherein said weight member is located behind and below the volumetric center of said body.

7. Underwater toy in accordance with claim 6, wherein said body is equipped with substantially horizontal wing members located along the sides of said body and having the form of fins, flippers, paws, hand palms or foils, placed along the side surfaces of said body to strengthen forward motion during a buoyancy movement (5).

8. Underwater toy in accordance with claim 5, wherein said body is equipped with substantially horizontal wing members located along the sides of said body and having the form of fins, flippers, paws, hand palms or foils, placed along the side surfaces of said body to strengthen forward motion during a buoyancy movement (5).

9. A weight-adjusted underwater toy comprising an elongate body having a well defined forward-rearward sense and a top-bottom sense and being adapted to provide a flight or glide movement in water when flung or thrown into the water, or when released from a submerged state, said body having a lower specific gravity than water, so that buoyancy will always occur in water, wherein the elongated body has its center of gravity located in a fixed position below and behind its volumetric center, said body has a streamlined shape with well defined forward movement direction shaped extremities, and wherein the well defined forward movement direction shaped extremities comprise substantially horizontal members located along the sides of said body and having the form of fins, flippers, paws, hand palms or foils, placed along the side surfaces of said body to facilitate forward motion of the toy during a buoyancy movement.

* * * * *